United States Patent [19]

Copenhaver

[11] 4,417,869

[45] Nov. 29, 1983

[54] FLAME ROLLOUT CONDITION SAFETY DEVICE FOR A COMBUSTION SYSTEM

[75] Inventor: Lloyd F. Copenhaver, Indianapolis, Ind.

[73] Assignee: Carrier Corporation, Syracuse, N.Y.

[21] Appl. No.: 230,561

[22] Filed: Feb. 2, 1981

[51] Int. Cl.[3] ..... G08B 17/12; F23N 5/24

[52] U.S. Cl. ..... 431/21; 200/61.08; 340/577; 361/103

[58] Field of Search ..... 431/22, 21; 169/61; 340/577, 590; 137/75; 361/103; 200/61.08; 337/413, 401, 416

[56] References Cited

U.S. PATENT DOCUMENTS

| | | | |
|---|---|---|---|
| 2,342,320 | 2/1944 | Ziegel . | |
| 2,640,920 | 6/1953 | Cairns, Jr. . | |
| 2,755,363 | 7/1956 | Pryor | 340/590 X |
| 3,377,448 | 4/1968 | Baumbach . | |
| 3,436,712 | 4/1969 | Heaney . | |
| 3,628,093 | 12/1971 | Crowley | 361/103 |
| 3,660,794 | 5/1972 | Brizzolara . | |
| 3,843,308 | 10/1974 | Graham et al. . | |
| 4,194,588 | 3/1980 | Wygal et al. | 200/61.08 X |
| 4,221,557 | 9/1980 | Jalics . | |

*Primary Examiner*—William E. Wayner
*Attorney, Agent, or Firm*—David L. Adour

[57] ABSTRACT

A safety device is disclosed for detecting a flame rollout condition at the burners of a combustion system and for shutting down the system in response thereto. The invention consists of using sections of the insulated leads, which are used for transmitting power from a fuel supply control transformer to a fuel supply system of the combustion system, as a flame rollout condition safety means. The sections of the leads are positioned so that the insulation burns off the leads to create a short circuit causing the transformer to over-heat and burn out thereby closing a fuel supply valve of the fuel supply system when a flame rollout condition occurs.

2 Claims, 3 Drawing Figures

FLAME ROLLOUT CONDITION SAFETY DEVICE FOR A COMBUSTION SYSTEM

BACKGROUND OF THE INVENTION

This invention relates to combustion systems and particularly to a safety device for shutting down a combustion system when a flame rollout condition occurs at the burners of the combustion system. Specifically, this invention relates to an inexpensive, redundant safety device for detecting a flame rollout condition at the burners of a combustion system and for discontinuing the flow of fuel to the burners of the combustion system when the flame rollout condition is detected.

A combustion system, such as a furnace, may, under conditions of insufficient or contaminated combustion air, or pressure buildup in the combustion chamber, develop what is known as a flame rollout condition. In this condition, the fuel-air mixture burns steadily outside the combustion chamber at the location of the burners of the combustion system.

Furnaces normally include a thermal fuse, electropyrotechnic link, or a flame sensor for use in the control wiring of the furnace to detect and respond to a flame rollout condition. These devices open an electrical circuit to a fuel supply valve which controls the flow of fuel to the furnace should temperatures in the control compartment, where the control wiring is located, exceed a certain value. Thus, these devices operate as thermal circuit breakers to open the electrical circuit to the furnace fuel supply valve thereby closing the valve and shutting down the furnace when a flame rollout condition occurs.

These thermal circuit breaker devices are special safety devices which are made a part of a combustion system but which are not necessary for the normal operation of the combustion system. Thus, although these special safety devices provide an important safety function, they increase the cost and complexity of the combustion system without increasing the operational performance of the system. Also, like any device, there is a possibility that the special safety device can malfunction, or be defeated by tampering.

It is desirable for a combustion system to have a redundant safety means for detecting and responding to a flame rollout condition. The use of a redundant safety means increases the probability of successfully detecting and responding to a flame rollout condition. However, the use of an additional special device, such as a thermal circuit breaker device, would further increase the cost and complexity of a combustion system without increasing the operational performance of the system. Therefore, it is advantageous to provide a redundant safety means for a combustion system for detecting and responding to a flame rollout condition without increasing the cost and complexity of the combustion system.

SUMMARY OF THE INVENTION

It is an object of the present invention to provide a safety device for shutting down a combustion system when a flame rollout condition is detected.

It is another object of the present invention to provide a flame rollout condition safety device for a combustion system to back-up a special flame rollout condition safety device such as a thermal fuse, electropyrotechnic link, flame sensor or other such device.

It is a further object of the present invention to provide a redundant flame rollout condition safety device for a combustion system which does not increase the cost or complexity of the combustion system.

It is a still further object of the present invention to provide a flame rollout condition safety device for discontinuing the flow of fuel to the burners of a combustion system when a flame rollout condition occurs at the burners of the combustion system.

These and other objects of the present invention are accomplished by properly locating sections of insulated leads which are used for transmitting power from a fuel supply control transformer to a fuel supply system of a combustion system. The sections of the insulated leads are in contact with each other and are located near the burners of the combustion system where a flame rollout condition can occur. The insulation melts or burns off the leads only when a flame rollout condition occurs to create a low resistance path, commonly called a short circuit, in the secondary circuit of the control transformer. This causes a sharp increase in the current in the transformer secondary winding causing the control transformer to over-heat and burn out thereby terminating the flow of power to the fuel supply system which closes a fuel supply valve and shuts down the combustion system.

DESCRIPTION OF THE PREFERRED EMBODIMENTS

Figure 1:
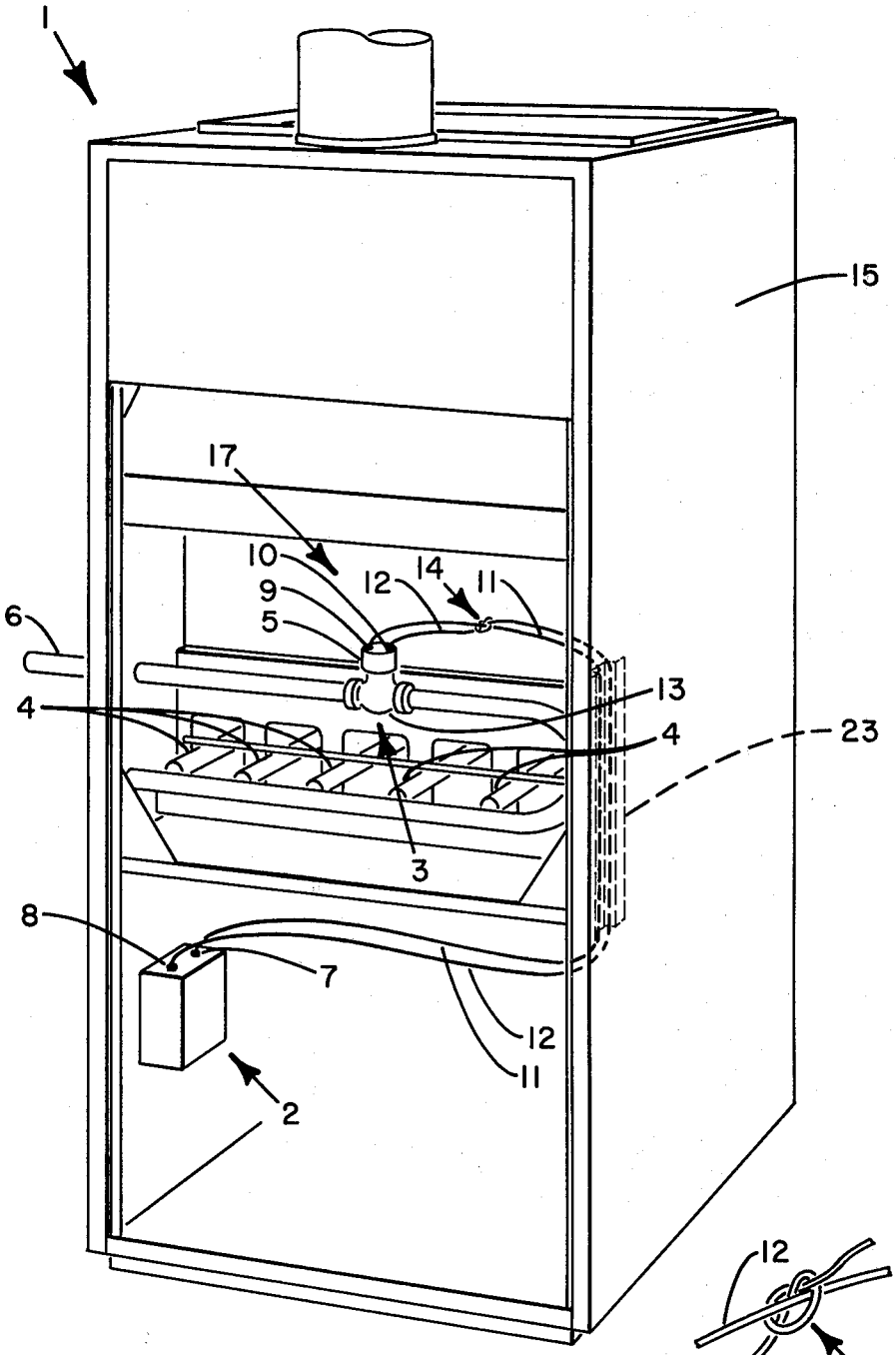
FIG. 1 shows a furnace having a flame rollout condition safety device constructed according to the principles of the present invention.

FIG. 1 shows a furnace fuel supply control transformer 2 electrically connected to a fuel supply system 3 for a furnace 1 having burners 4. The connection is designed so that if a flame rollout condition occurs at the burners 4 the fuel supply control transformer 2 is disabled and the furnace 1 is shut down. The fuel supply control transformer 2 supplies electrical power to control the operation of the fuel supply system 3 of the furnace 1. Typically, the fuel supply system 3 includes a fuel supply line 6 with an electrically actuated fuel supply valve 13 which is held open by the flow of current through a valve operator 5 such as a solenoid coil, heat motor or similar device. The flow of current through valve operator 5 is caused by the transformer 2 supplying a voltage across valve operator 5. The valve 13 is held open only while power is provided to the fuel supply system 3 so that current flows through valve operator 5. If no current flows through valve operator 5 the valve 13 is closed and the flow of fuel to the burners 4 is discontinued thereby shutting down the furnace 1.

As shown in FIG. 1, the transformer 2 has an electrical power supply connection 7 and an electrical ground connection 8. The power supply connection 7 of the transformer 2 is connected to the power supply connection 9 of the fuel supply system 3 by insulated power supply lead 11. The ground connection 8 of the transformer 2 is connected to the ground connection 10 of the fuel supply system 3 by insulated ground lead 12.

Thus, the transformer 2 directly controls the opening and closing of the fuel supply valve 13. The leads 11 and 12 are run through wiring harness 23 to hold the leads 11 and 12 in a selected position.

Figure 3:
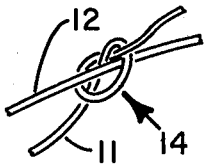
FIG. 3 shows an enlarged view of the knotted section 14 of the insulated electrical leads 11 and 12 shown in FIG. 1.

As shown in FIG. 1 and in FIG. 3, a section of the power lead 11 is tied in a knot 14 around the ground lead 12. The knot 14 is located near the burners 4 of the furnace 1 so that the leads are in a position to detect a flame rollout condition. The knot 14 is preferably located 6 to 8 inches above the burners 4 in the burner compartment 17 of the furnace 1. The knot 14 may be held in this position by brackets (see FIG. 2) but this is not required. The exact positioning of the knot 14 is not critical since the safety device is primarily a back-up safety device designed to respond under a severe flame rollout condition. However, the safety device can be designed to respond to any type of flame rollout condition. This is accomplished by properly positioning the leads 11 and 12 so that if a flame rollout condition occurs the insulation on the leads 11 and 12 melts or is burned off at the position of the knot 14 thereby shorting together the conductors of the leads 11 and 12. This short circuit causes the control transformer 2 to overheat and burn out thereby preventing the transmission of power to the fuel supply system 3 and stopping the flow of current through valve operator 5. This causes the fuel supply valve 13 to close thereby shutting down the furnace 1.

The conductors of the electrical leads 11 and 12 preferably contact due to gravity when the insulation on the leads is melted or burned off when a flame rollout condition occurs. The leads may be biased, placed under tension, or arranged in other similar ways but this is not required. The insulation on the leads 11 and 12 only needs to melt or burn away at a lower temperature than the melting temperature of the conductors of the leads 11 and 12. The lower temperature at which the insulation melts should be less than flame temperatures in a flame rollout condition. However, the insulation melting temperature should be substantially greater than ambient temperatures present during normal operation of the furnace 1.

Figure 2:
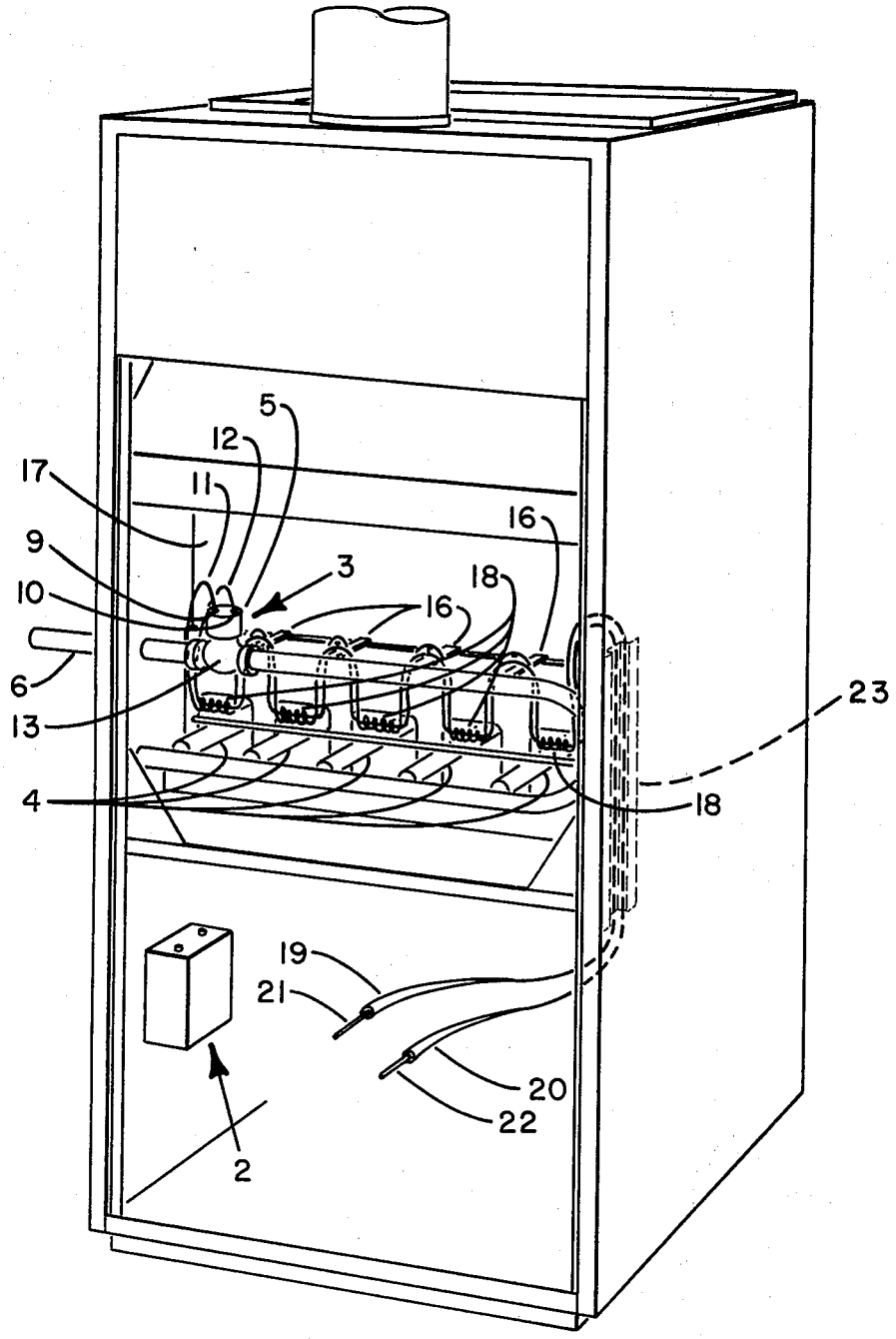
FIG. 2 illustrates an alternative embodiment of a flame rollout condition safety device constructed according to the principles of the present invention.

Typically, the leads 11 and 12 consist of metal conductors 21 and 22, such as copper, coated with a plastic material 19 and 20, respectively, such as polyvinalchloride, as shown in FIG. 2 wherein the same reference numberals used in FIG. 1 are used to identify identical elements shown in FIG. 2. The polyvinalchloride electrically insulates the copper conductors 21 and 22 and has a melting point of about 105° C. Copper has a much higher melting point of about 1083° C. Flame temperatures in a flame rollout condition typically vary between 150° to 200° C. Therefore, if a flame rollout condition occurs, the polyvinalchloride will melt at the position of the knot 14 thereby bringing the copper conductors 21 and 22 into contact and creating a short circuit which causes the control transformer 2 to overheat and burn out. This ends the flow of current through the valve operator 5 thereby shutting down the furnace 1 by closing the fuel supply valve 13 to discontinue the fuel flow to the burners 4 of the furnace 1. This should be contrasted with the operation of special safety devices such as a thermal fuse, electropyrotechnic link or other such device. These special devices create open circuits rather than short circuits.

It should be noted that the present invention is intended primarily to be a redundant safety device. The primary flame rollout condition control device would be a thermal fuse, electropyrotechnic link, flame sensor, or other such device. If this primary device malfunctioned then the present invention would operate as a back-up safety device to shut down the combustion system when a flame rollout condition is detected. The probability of two safety devices malfunctioning is much less than the probability of either safety device alone malfunctioning. This increase in safety protection is achieved, according to the principles of the present invention, without any increase in the cost or complexity of the combustion system.

The present invention has been described as having a section of the insulated power supply lead 11 tied in a knot 14 about the insulated ground lead 12. However, an equivalent configuration is to tie a section of the insulated ground lead 12 about the insulated power supply lead 11 in a knot at the same location. Additionally, it should be noted that the use of two insulated leads is not required. For example, the power supply lead 11 could be positioned relative to any grounding medium, such as a metal cabinet 15 housing the combustion system, so that when a flame rollout condition occurs the insulation burns off the lead 11 bringing the conductor into electrical contact with this grounding medium. Various other such arrangements are possible.

Also, the present invention has been described as having leads 11 and 12 with only one knot 14 located near the burners 4. However, a plurality of knotted sections may be used. For example, FIG. 2 shows the burner compartment 17 of the furnace 1, shown in FIG. 1, having knotted sections 18 located near each of the burners 4. As shown in FIG. 2, each knotted section 18 is held in position by a bracket 16. However, the brackets 16 are not necessarily required. Each knotted section 18 is preferably located directly above each burner 4. Thus, a rollout condition may be detected at each individual burner. Then, even if flame rollout occurs at only one of the burners 4 the safety device quickly responds to close the valve 13 of the fuel supply system 3 thereby shutting down the furnace 1.

Thus, there are many configurations for the insulated leads which connect a fuel supply control transformer to a fuel supply valve that result in a control means for a combustion system which will operate to shut down the combustion system when a flame rollout condition occurs at the burners of the combustion system. Therefore, while the present invention has been described in connection with particular embodiments, it is to be understood that various modifications may be made without departing from the scope of the invention heretofore described and claimed in the appended claims.

What is claimed is:

1. A safety device for discontinuing the flow of fuel to the burners of a combustion system when a flame rollout condition occurs at the burners, said device comprising:

a fuel supply means for supplying fuel to the burners of the combustion system;

an electrically actuated valve means for controlling the flow of fuel from the fuel supply means to the burners, said valve means allowing fuel flow to the burners only when electrical power is supplied to the valve means;

a power supply means for providing electrical power for the electrically actuated valve means;

an electrical power supply lead having a conductor, with a covering of electrical insulation which is capable of being melted or burned away by heat, for supplying electrical power from the power supply means to the electrically actuated valve means, said lead having at least one section located at a position where flame rollout can occur; and a grounding medium in contact with each section of the power supply lead which is located at a position where flame rollout can occur, said grounding medium providing a low resistance path for shunting the electrical power from the power supply means to ground only when the conductor of the power supply lead contacts the grounding medium whereby electrical power from the power supply means does not reach the electrically actuated valve means and fuel flow to the burners of the combustion system is discontinued if a flame rollout condition occurs.

2. The safety device as recited in claim 1 wherein the grounding medium comprises a ground lead having a conductor, with a covering of electrical insulation which is capable of being melted or burned away by heat, said ground lead electrically connected between the power supply means and the electrically actuated valve means to form a complete circuit for the transmission of electrical power between the power supply means and valve means.

* * * * *